US005941572A

United States Patent [19]

Gundjian et al.

[11] Patent Number: 5,941,572

[45] Date of Patent: Aug. 24, 1999

[54] METHOD FOR AUTHENTICATING A TEXTILE PRODUCT AND A THREAD AND A WOVEN LABEL USABLE THEREWITH

[75] Inventors: Arshavir Gundjian, Montreal; Abraham Kuruvilla, Ormstown, both of Canada

[73] Assignee: Nocopi Technologies, Inc., West Conshohocken, Pa.

[21] Appl. No.: 08/928,910

[22] Filed: Sep. 12, 1997

[51] Int. Cl.[6] ..... B42D 15/00

[52] U.S. Cl. ..... 283/67; 283/95; 428/913; 428/914; 8/140; 8/252

[58] Field of Search ..... 28/140, 252; 112/403; 139/426 R; 427/434.6; 428/36.2, 913, 914; 283/67, 95

[56] References Cited

U.S. PATENT DOCUMENTS

| | | | |
|---|---|---|---|
| 3,819,324 | 6/1974 | Bino | 8/164 |
| 3,883,298 | 5/1975 | Platt | 8/2 |
| 4,717,710 | 1/1988 | Shimizu et al. | 428/913 X |
| 4,940,690 | 7/1990 | Skees | 428/914 X |
| 5,289,547 | 2/1994 | Ligas et al. | 283/95 X |
| 5,460,880 | 10/1995 | Patnode et al. | 428/913 X |

FOREIGN PATENT DOCUMENTS

| | | |
|---|---|---|
| 328320 | 8/1989 | European Pat. Off. . |

*Primary Examiner*—Frances Han
*Attorney, Agent, or Firm*—Sprung Kramer Schaefer & Briscoe

[57] ABSTRACT

A method for authenticating a textile product, wherein a colorless composition is applied to at least one portion of at least one thread of the textile product. The composition comprises one of a pair of a colorformer and an activator which react when mixed to produce a spectral response. The textile product is authenticated as genuine by applying the other of the pair of the colorformer and activator to at least one portion of the at least one thread to produce the spectral response. The textile product may be a thread or a woven label.

16 Claims, 4 Drawing Sheets

METHOD FOR AUTHENTICATING A TEXTILE PRODUCT AND A THREAD AND A WOVEN LABEL USABLE THEREWITH

BACKGROUND OF THE INVENTION

The manufacturers of high quality, high profile and hence highly priced brand name clothing or textile products are necessarily concerned by the possibility that a counterfeiter can reproduce such products with good or even moderate fidelity and to sell them on the market as genuine, thereby essentially stealing the brand name value from the legitimate manufacturer that the manufacturer has succeeded, as a result of tremendous efforts and expenditures, to build into such products. An equally important concern is, of course, the serious danger that a lower quality counterfeited product might destroy the image and hence the confidence in the genuine product that has also been created, of course, at great expense and effort by the original manufacturer.

Consequently, it has become vitally important to be able to positively identify an original textile product against a counterfeit clone.

The present invention relates to a system and apparatus for the convenient authentication of legitimate and authentic textile products including clothing and the like. A number of features are considered to be essential for an authentication device to be efficient and commercially acceptable for such products. For instance, it is important that the method of identification be simple and, thus, not require in its utilization, highly technical skills and complex technical devices. This is because an inspector must be able to perform the verification task easily away from the manufacturing site, e.g., in the field, often in an adverse environment. Also, for an anti-counterfeit scheme to be effective, each and every one of the authentic product items must carry the identification device. In order to keep the cost of the protective scheme at a reasonable level, it must be possible to attach the identification device to each given product item easily during the normal manufacturing process without disturbing the normal evolution of the latter, preferably without adding any new steps.

It is also important that the identification device be covert so that the counterfeiter will not to be able to locate it, identify it and hence duplicate it with more or less success, thereby creating confusion in the minds of the inspector, and even more importantly in the mind of the purchaser of the product. We will qualify hereafter such covertness as "transparence", meaning that the presence of the device must not perturb or modify in any manner the visual aspect that the product has, before the introduction of the authenticating device. Moreover, considering the fact that certain textile products, such as jeans, trousers, skirts, and other similar clothing products are subjected to a more or less intentionally harsh washing process before they are put on the shelf for selling, in such products, the authentication device must be ingeniously protected in order to survive the obviously abrasive and hence destructive effect of such washes.

SUMMARY OF THE INVENTION

The present invention provides a dramatically effective solution that fulfills all of the above-mentioned needs. Since every brand name product carries at least one solidly attached woven label that fully identifies the product, we consider the introduction of the authentication device in the woven label sufficient to protect the product as a whole. If need be, however, the authentication technique disclosed herein described for the protection of the label can just as well be chosen to be used directly on the product in order to authenticate and protect the textile material which is used to make the product.

These and other features and advantages of the present invention are achieved in accordance with the present invention as described hereinafter with reference to the attached drawings and the detailed description of the invention.

DETAILED DESCRIPTION OF THE INVENTION

Figure 1:
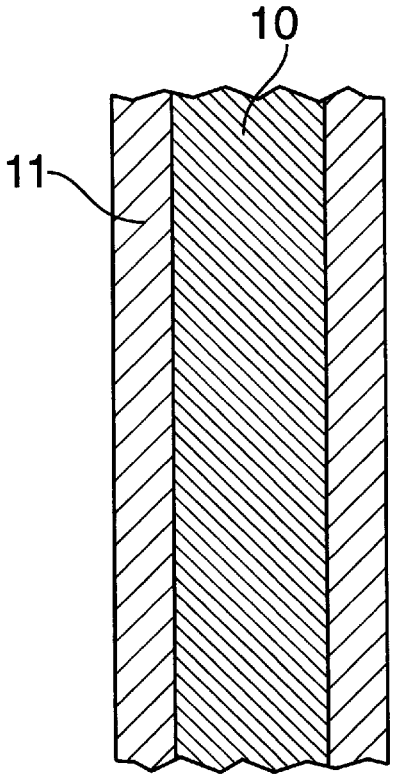
FIG. 1 is a cross-sectional view of a thread or fiber according to the present invention.

The present authentication technique makes use of two fundamental components that are identified as components A and B. Component A is a coating solution, which is essentially colorless, hence transparent, and, therefore, covert. A number of compositions can be used to make the coating A, as further described hereinafter. This invention can be implemented by using the coating of Component A to either coat selectively one or more of the yarns or fibers used in the normal weaving of a given brand name label, or by using the coating solution A as a finishing coating solution, which can be used to entirely coat a woven label for ease of handling and other purposes or as well by adding the coating solution of Component A to the otherwise used normal finishing coating solution of a given label.

Component B is provided in the form of a second solution which, in one convenient configuration, is filled in a highlighter pen structure. When Component B is applied on Component A, which is carried by the label prepared according to the procedure described herein, a chemical reaction takes place. Depending on the specific composition of Components A and B, the reaction will appear either in the form of the Component A coated part of the label suddenly changing its color, or becoming fluorescent with a characteristic tint that can be seen particularly when the label is exposed further to an ultraviolet light. In the first case, a reactive color change is said to have taken place, and in the second case, we say that on demand fluorescence has been switched on. The latter clearly remains essentially imperceptible to the eye of the viewer, especially when the thread is originally of dark color, under normal lighting, but becomes vividly evident to the viewer when the ultraviolet source of illumination is provided.

The preferred method of protection is the treated yarn approach described above. In this case, the identifying reaction of B on A obviously takes place only on those areas of the woven material where the treated yarn is present. Thus, the identification reaction can further be made to result in a revealed message: a name, a number, a logo, etc. On the other hand, when the protection scheme is such that the entire label is coated with Component A, the application of Component B will result in a reaction on any part of the treated label and will only provide positive confirmation of the presence of the authentication coating.

It is clear that, in accordance with the present disclosure, an important part of the invention is to formulate Component A in such a manner that besides having the proper chemical composition, it adheres solidly to the treated fiber. An even more stringent requirement exists in the case where the labels are expected to be subjected to more or less severe pre-sale washing treatments. In this case, Component A must be made such as to remain chemically and mechanically intact to achieve this result. We have found that the active ingredients of the Component A have to be isolated from the chemical and mechanical elements of the washing treatment by means of an envelope efficiently protective against such active ingredients. The envelope must be mechanically solid to sustain as much as possible the harsh effects of what is generally known as stone washing and chemically impermeable in order to prevent the contents of often aggressive washing additives, which vary immensely from one wash case to another, from traversing the envelope barrier.

The Component A, when used without an envelope, can be in a water base solution, as well as a solvent base solution. It must provide good adhesion to the yarn and yet must leave the softness of the fiber or yarn and/or the label substantially unaffected. The components of A consist of binders, a water repellant, softeners, curing compounds and a reactive component which can be one of the two types of a chemically reactive pair that we shall call "AA" or "AD". Typical examples of AA may be from the very wide spectrum of so-called leucodye activators, such as modified Novalac resins, bisphenols and hydroxybenzoates, of which a specific example is 4-hydroxy-4'-isopropoxy-diphenyl sulfone. On the other hand, typical examples of AD may be from the wide spectrum of so-called leucodyes, such as Hilton Davis CK4 which is chemically characterized as $C_{31}H_{28}N_2O_3$, 6'-(Dimethylamino)-3'methyl-2'-(phenylamino) spiro (isobenzofuran)-1(3H), 9'-(9H) or Hilton Davis CK14 which is chemically characterized as $C_{44}H_{56}N_2O_2$3-(4-Dimethylamino) phenyl-3-(di(4-octyl)phenylamino)1-(3H)-isobenzofuranone.

Examples of a water base solution A, based on reactive components AA or AD, are as follows:

(a) finely micronized AA or AD materials in simple suspension or microencapsulated, as described herein, and then put in suspension;

(b) surfactants;

(c) urethane and/or acrylate binders;

(d) pH buffer (e) catalyst (f) softener (g) cross-linker (h) defoamer (i) rheology modifier (j) water-repellents.

Examples of solvent-based solution A, based on reactive components AA or AD are as follows:

(a) either AA or AD active ingredients (b) solvents, such as alcohol, a hydrocarbon or mineral oil;

(c) binders, such as urethane, polyketone resins or phenolic resins;

(d) softeners (e) rheology modifiers (f) water-repellents.

In order to provide a protective envelope to the reactive ingredients AA or AD of the solution of Component A, we insert either one of these materials, identified as AA and AD above, into microcapsules, using the widely-known methods of the microencapsulation technology. The encapsulation of reactive components is well-known in the carbonless paper technology, encapsulation is also used typically in the making of perfume samples often used in magazines. We find that the encapsulation process is the most convenient and effective means to achieve the protective envelope function, as described above. The spherical walls of the microcapsule are a few microns in diameter, typically less than $10\mu$ and preferably $2–7\mu$, and provide an enormous mechanical resistance to rupture when hit with "blunt" objects, which is how the stone washing process can be characterized, in view of the size of the metallic or other objects used in the processes relative to the micron size of the capsule spheres. Furthermore, a judicious choice in the material of the walls from many chemically impermeable components that typically are from the family of polyvinyl alcohols, polyamides, polyurethanes, polysulphonamides, polyesters and polysulphonates, assures a very high level of protection against chemical penetration inside the capsules and, therefore, of protection against neutralizing the reactive chemicals AA or AD during a harsh textile washing process.

The thread or label coating solution of Component A is then obtained by simply substituting, in the above-described formulation of the coating solution of Component A, the reactive components AA or AD in their encapsulated form. Furthermore, note that in this case, only water-based solutions are used to prevent damaging the capsule walls in a solvent environment.

We have found that when very high levels of protection are required both the mechanical and chemical protections offered by the microencapsulation techniques are dramatically multiplied in efficiency when the microcapsules are re-encapsulated, thus providing a double wall protection, or even if need be further re-encapsulated, thus providing a triple wall protection.

As a general observation concerning the protection of the coating A with a chemically and mechanically resistant envelope, another approach is to top coat a fiber or label that is precoated with one of the solutions described above with an additional, separate protective top coat which is typically made of a curing composition.

In this case, however, generally a substantial change in the softness of the original yarn or label is to be expected, rendering the latter stiff. Since, in many situations, this stiffening is found to be objectionable by the garment manufacturer, the microencapsulation approach for the protective envelope is the preferred method of implementation of this concept.

The solution of Component B is in the form of a solution of the one of the reactive components identified above, either AA or AD, in a solvent, such as alcohol, acetone, methylethyl ketone and others, or a combination of such solvents.

When the solution of Component A is based on the reactive components AA, the solution of Component B is made using components from AD. When, on the other hand, the solution of Component A is based on AD, then solution of Component B is made using components from the AA family.

EXAMPLES

Waterbased Coating-formula, A

| | Wet wt |
|---|---|
| Water | 55.0% |
| Wetting agent | 1.0 |
| Anti-migrant | 2.0 |
| Binder AB (30%) | 15.0 |
| Fix-1A Cross linker | 1.5 |
| Active component, AA or AD (35%) | 20.0 |
| Softener/Water repellent | 5.0 |
| Defoamer | 0.5 |
| | 100.00 |

Solventbased Coating-formula, A

| | |
|---|---|
| Mineral Spirit | 87–75% |
| Active component (AA or AD) | 5–10 |
| Binder | 5–10 |
| Corning C-2-0563 (Water repellant) | 3–5 |
| | 100.00 |

FIG. 1 shows a fiber 10 according to the present invention having the coating 11 of solution A thereon. Since the coating 11 is colorless, one cannot tell from fiber 10 with an unaided eye that there is any difference between fiber 10 with the coating and fiber 10 without the coating.

Figure 2:
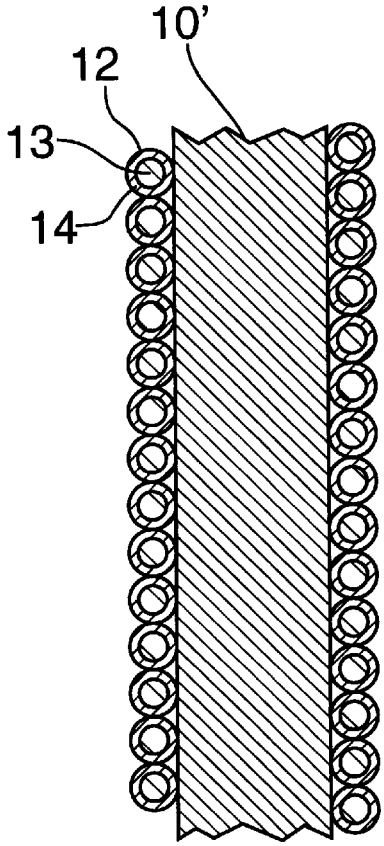
FIG. 2 is a cross-sectional view of another embodiment of a thread or fiber according to the present invention.

FIG. 2 shows another embodiment of a fiber 10' according to the present invention having microcapsules 12 adhered thereto. Each microcapsule includes a colorless solution of Component A in a central portion 13 and transparent walls 14. The figure is not to scale for the sake of clarity.

In this embodiment, it would not be possible to determine, with an unaided eye, the difference between fiber 10' with the microcapsules connected thereto and a fiber with no such coating.

Figure 3:
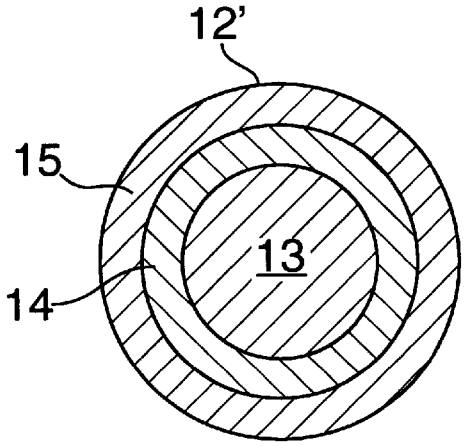
FIG. 3 is a cross-sectional view of a microcapsule according to the present invention.

FIG. 3 shows an alternative embodiment of the present invention wherein each microcapsule 12' has a second wall 15 formed thereon for added protection. A third, and even more walls, can also be applied if necessary.

Figure 4:
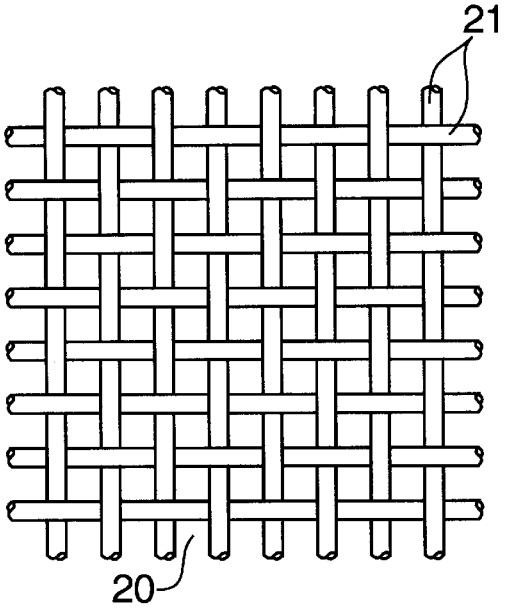
FIGS. 4–6 are top views of a woven label according to the present invention used in accordance with the method according to the present invention.

In accordance with the method of the present invention, a woven substrate 20 shown in FIG. 4 has horizontal and vertical woven fibers 21. In the embodiment shown therein, each of the fibers 21 is completely coated with a solution of Component A. The coating is carried out either before the fibers are woven or thereafter. The fibers are coated with Component A in the manner of FIGS. 1–3 or other combinations thereof which would be clear to one of ordinary skill in the art.

It should be noted that the woven substrate 20 can be a label attached to a garment or the like or it can be part of the textile product itself.

Figure 5:
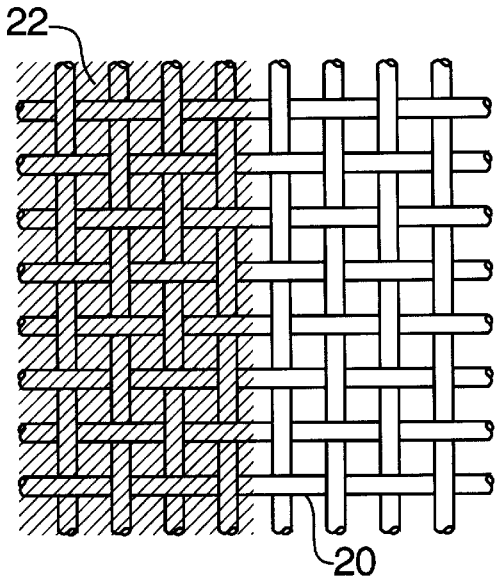

As shown in FIG. 5, the Component B is applied in area 22 by means of an applicator, such as a highlighter pen having the Component B in solution.

Where the Component A is contained in microcapsules as shown in FIG. 2, the Component B is carried in a solvent which dissolves the microcapsules to effect a mixing of Component A and B.

Figure 6:
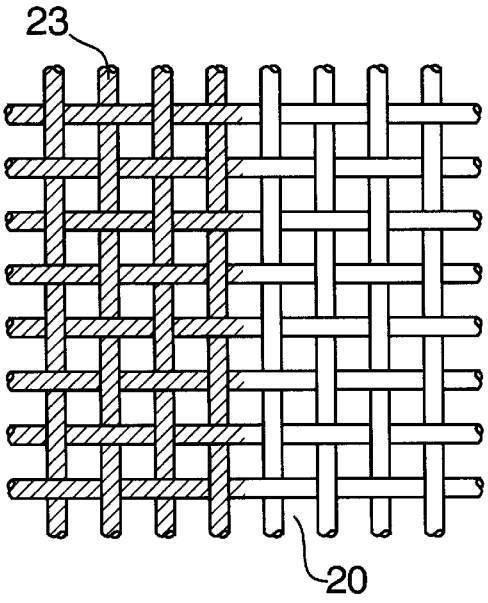

In the embodiment shown in FIG. 6, the mixing of Components A and B produces a visible spectral response 23 in the portion of the substrate to which the activator 22 has been applied.

Figure 7:
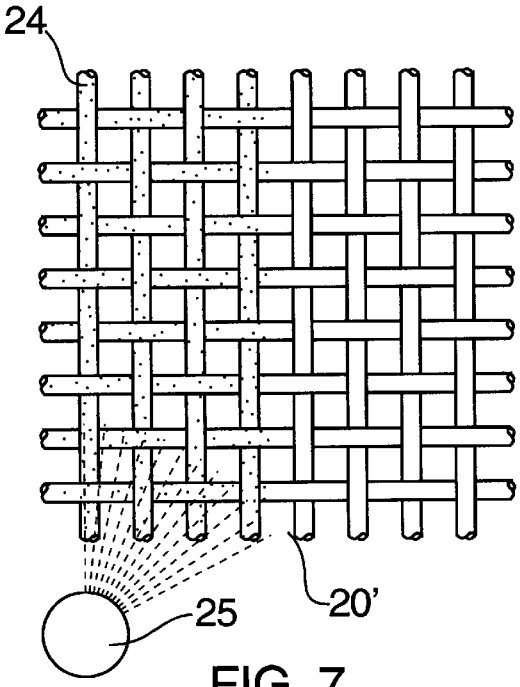
FIG. 7 shows an alternative embodiment of the method of FIGS. 4–6.

In FIG. 7, the substrate 20' has Component A, which when mixed with Component B, produces a fluorescent spectral response, which is not visible in normal light, especially when the untreated thread is of a dark color, but which is only visible as shown by spectral response 24 when viewed under ultraviolet light from source 25.

Rather than covering an entire area of the substrate with the Component A, another use of the present invention, as shown in FIGS. 8–11, incorporates the selective coating of fibers in a woven substrate, such as a label or a woven garment or other product itself, to hide a latent image of a message, such as a name, a logo or a number.

Figure 8:
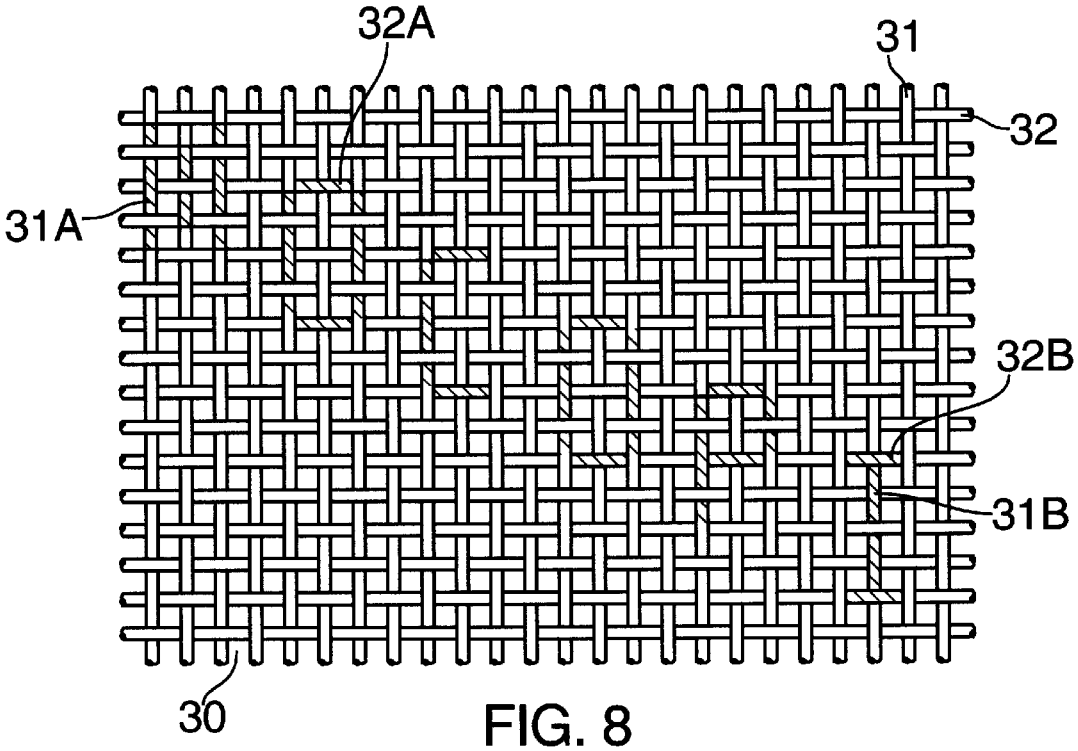
FIGS. 8–10 show another embodiment of the method according to the present invention.

As shown in FIG. 8, depending on the specific weaving method used, vertical and horizontal fibers 31, 32 are selectively coated in areas, such as 31A, 31B, 32A and 32B, to produce a latent image of a name which is not visible to an unaided eye, and because it is only exposed in a small portion of the overall area of the substrate, would be difficult to find unless one knows where to look for it.

Figure 9:
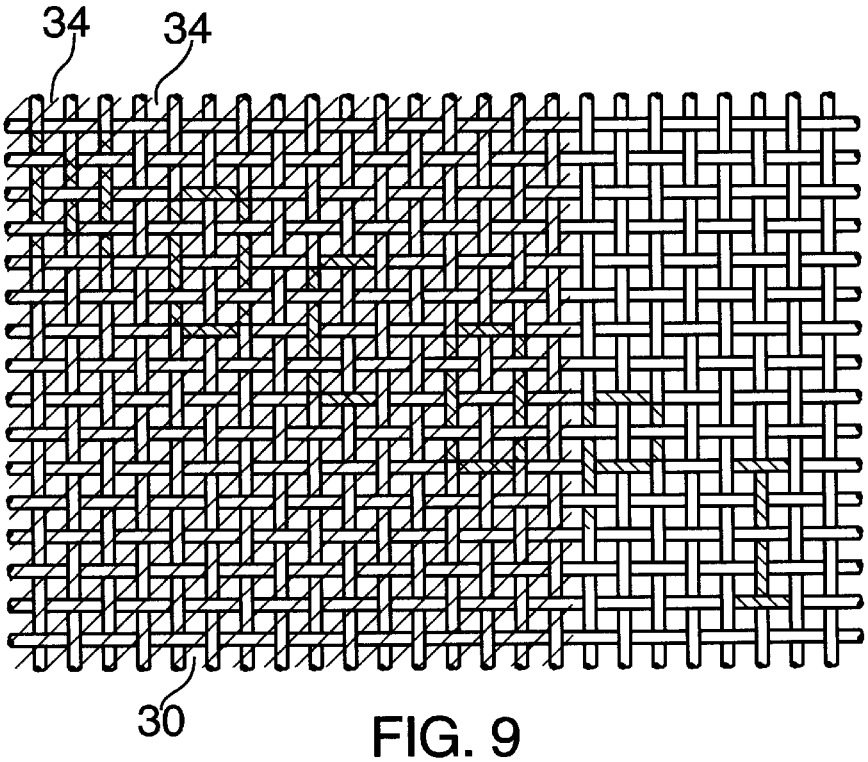

As shown in FIG. 9, in order to determine the genuineness of the article, Component B is applied in area 34 of substrate 30.

Figure 10:
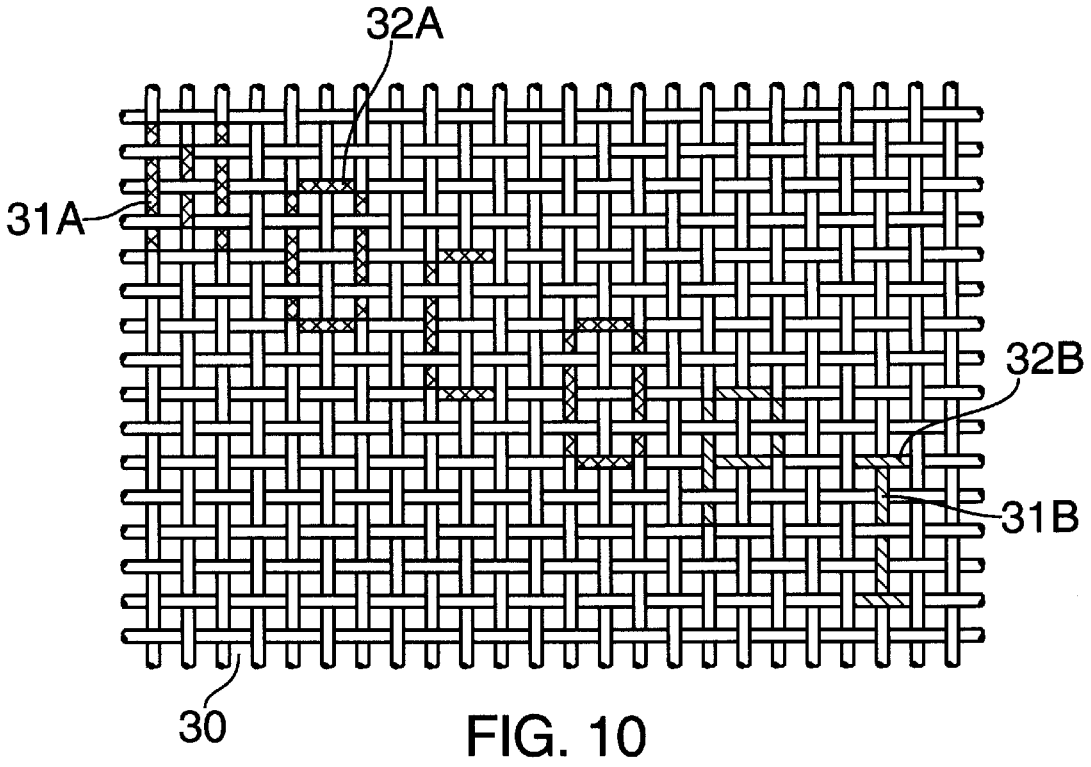

The result is shown in FIG. 10 where a spectral response is achieved due to the mixing of Components A and B in, for example, the coated portions 31A and 32A. Thus, one can see "NOCO" on the substrate. In areas 31B and 32B where the activator has not been applied, the image "PI" is still latent.

Figure 11:
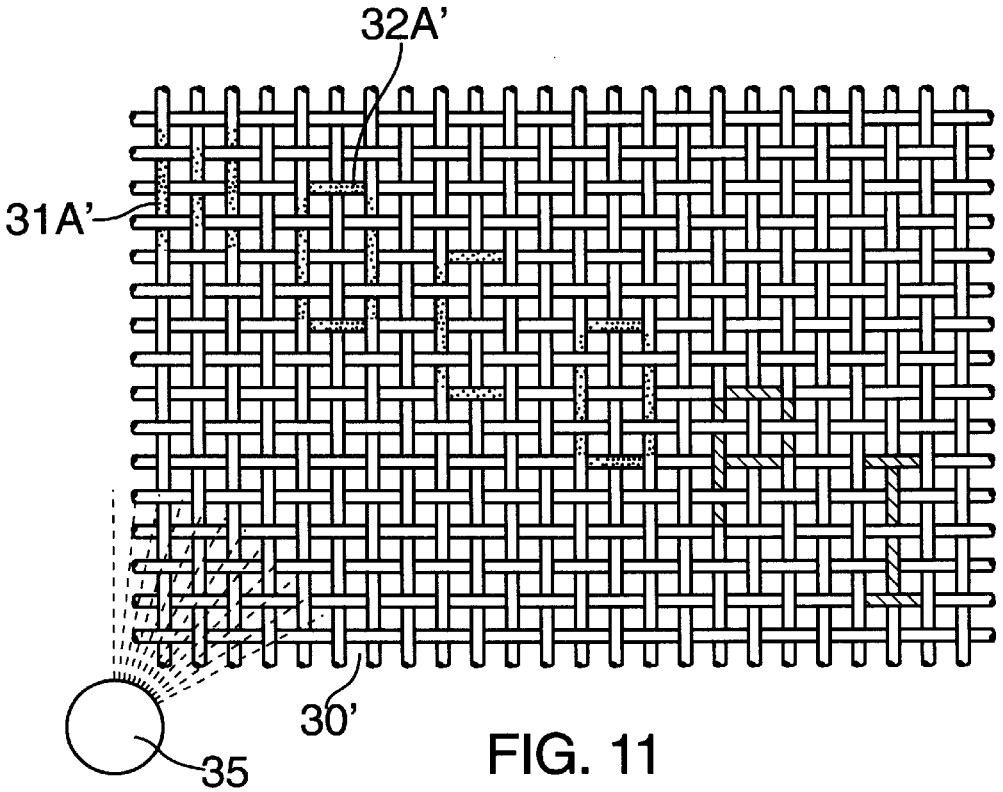
FIG. 11 shows an alternative of the embodiment of the method of FIGS. 8–10.

In the alternative embodiment shown in FIG. 11, the activation of substrate 30' only results in a spectral response in, for example, coated portions 31A' and 32A' which is not visible in normal light and "NOCO" is only visible when viewed in ultraviolet light from ultraviolet light source 35, whereas "PI" would not be visible even under UV light.

It is noted that in the above-described embodiments, the authentication scheme is based on keeping the two active components A and B physically separated up to the point where the authentication process is to take place, at which point a solvent intervenes in order to allow A and B to mix and react with each other.

A further alternative to the above embodiments has been worked out where the two components A and B are initially put in intimate physical proximity but they are prevented from reacting chemically. This is achieved by utilizing a thread or label coating solution which is identical to the water-based solution given in the above first example but where the active component described in (a) is a mixture of both AA and AD materials micronized to a size of the order of microns where the range of micronization can be from submicrons to about 15$\mu$ but more commonly from about 1$\mu$ to about 10$\mu$. The proportion of AA to AD micronized solids is of the order of 4 to 1. This proportion is, however, not critical. Since the micronized particles AA and AD are placed in an aqueous medium and they are both chosen to be insoluble in water, they will not chemically react with each other. After the thread or the woven label that is desired to be authenticated is coated with this aqueous solution, the activation process requires simply a brisk scratching action on the coated portion of the label, the heat and pressure associated with this scratching action will merge the AA and AD components into each other and the chemical reaction takes place, thus producing a perceptible color change or rendering the scratched areas fluorescent, depending on the specific components used as AD micronized material. This type of embodiment is otherwise described as the "rub and reveal" or "scratch and reveal" process of authentication. It is best suited for applications that do not involve a presale washing process.

Another alternative embodiment for the scratch and reveal version of the protection technology is when of the two active components AA and AD used the in water-based coating solution, one is micronized as described above and the other is used in a microencapsulated solubilized form similar to the description given in FIG. 3. In this case, clearly the microencapsulated active micronized and originally unsolubilized component will be in intimate proximity with the micronized conjugate active component, however, the microcapsule walls will prevent any chemical reaction from taking place. Upon briskly scratching the treated surface, however, the microcapsule walls will break and the one active component in solution will meet and react with the other active component, thereby providing the authentication signal of color change or switched on fluorescence.

Clearly in this rub and reveal or scratch and reveal embodiment, the authentication process is simple in that it does not require any special highlighter. All that is needed is the fingernail or any other sharp object made preferably of a non-thermally conducting material.

It is understood that the embodiments described hereinabove are merely illustrative and are not intended to limit the scope of the invention. It is realized that various changes, alterations, rearrangements and modifications can be made by those skilled in the art especially in the art of weaving without substantially departing from the spirit and scope of the present invention.

What is claimed is:

1. A method for authenticating a textile product, comprising the steps of:

applying a colorless composition to at least one portion of at least one thread constituting a textile product, wherein the composition comprises at least one of a pair of a colorformer and an activator which react when mixed to produce a spectral response; and authenticating the textile product as genuine by mixing the other of the pair of the colorformer and activator at said at least one portion of the at least one thread in the presence of a solvent to produce the spectral response.

2. The method according to claim 1, wherein the colorless composition is applied to the at least one thread before the textile product is made.

3. The method according to claim 1, wherein the colorless composition is applied to the at least one thread after the textile product is made.

4. The method according to claim 1, wherein the colorless composition is applied in solution to coat the at least one thread.

5. The method according to claim 1, wherein the step of applying comprises microencapsulating the colorless composition in microcapsules and adhering the microcapsules to the at least one thread.

6. The method according to claim 5, wherein only one of the pair is applied in the colorless composition and the other of the pair is mixed by applying same in a solvent carrier to dissolve the microcapsules.

7. The method according to claim 1, wherein the spectral response is visible to an unaided eye.

8. The method according to claim 1, wherein the spectral response is visible only under ultraviolet light.

9. The method according to claim 1, wherein the textile product is a woven label.

10. The method according to claim 9, wherein the label is completely coated with the colorless composition.

11. The method according to claim 9, wherein the label is coated on predetermined portions of predetermined threads to define a predetermined latent image.

12. The method according to claim 11, wherein the latent image is a message.

13. The method according to claim 11, wherein the latent image is a logo.

14. The method according to claim 11, wherein the latent image is a number.

15. The method according to claim 1, wherein only one of the pair is applied in the colorless composition and the other of the pair is mixed by applying same using a highlighter.

16. The method according to claim 1, wherein both of the pair are in intimate physical proximity in the colorless composition and prevented from reacting and wherein mixing comprises applying at least one of heat and pressure to the composition to effect a reaction.

* * * * *